US010957251B2

(12) United States Patent
Hwang et al.

(10) Patent No.: US 10,957,251 B2
(45) Date of Patent: Mar. 23, 2021

(54) PIXEL SENSING DEVICE AND PANEL DRIVING DEVICE

(71) Applicant: SILICON WORKS CO., LTD., Daejeon (KR)

(72) Inventors: Dong Hyun Hwang, Daejeon (KR); Hyun Ho Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 16/492,021

(22) PCT Filed: Feb. 28, 2018

(86) PCT No.: PCT/KR2018/002441
§ 371 (c)(1),
(2) Date: Sep. 6, 2019

(87) PCT Pub. No.: WO2018/164409
PCT Pub. Date: Sep. 13, 2018

(65) Prior Publication Data

US 2020/0013333 A1 Jan. 9, 2020

(30) Foreign Application Priority Data

Mar. 9, 2017 (KR) ..... 10-2017-0029947

(51) Int. Cl.
*G09G 3/3233* (2016.01)
*G09G 3/00* (2006.01)
*G09G 3/3275* (2016.01)

(52) U.S. Cl.
CPC ..... *G09G 3/3233* (2013.01); *G09G 3/006* (2013.01); *G09G 3/3275* (2013.01); *G09G 2320/046* (2013.01)

(58) Field of Classification Search
CPC ... G09G 2300/0842; G09G 2320/0233; G09G 2320/0295; G09G 2320/043; G09G 2320/046; G09G 3/00; G09G 3/006; G09G 3/3233; G09G 3/3275
See application file for complete search history.

(56) References Cited

U.S. PATENT DOCUMENTS

| | | | |
|---|---|---|---|
| 9,202,411 | B2 | 12/2015 | Jung et al. |
| 9,424,770 | B2 | 8/2016 | Kim et al. |
| 2014/0152642 | A1 | 6/2014 | Kim et al. |
| 2014/0176622 | A1 | 6/2014 | Jung et al. |

(Continued)

FOREIGN PATENT DOCUMENTS

| | | | | |
|---|---|---|---|---|
| EP | 2738757 | A1 * | 6/2014 | ..... G09G 3/3208 |
| KR | 10-2014-0071097 | A | 6/2014 | |
| KR | 10-2014-0083680 | A | 7/2014 | |

(Continued)

OTHER PUBLICATIONS

PCT International Search Report, PCT/KR2018/002441, dated Jun. 8, 2018, 4 Pages.

*Primary Examiner* — Temesghen Ghebretinsae
*Assistant Examiner* — Sosina Abebe
(74) *Attorney, Agent, or Firm* — Fenwick & West LLP

(57) ABSTRACT

The present invention relates to a pixel sensing device capable of compensating for an error included in a test current itself by supplying, when a pixel current is sensed, the test current used in the sensing of each channel circuit error.

12 Claims, 10 Drawing Sheets

(56) References Cited

U.S. PATENT DOCUMENTS

2016/0063950 A1* 3/2016 Shin ..... G09G 3/20
345/212
2016/0163255 A1* 6/2016 Kim ..... G09G 3/3291
345/212

FOREIGN PATENT DOCUMENTS

KR 10-2014-0107752 A 9/2014
KR 10-2015-0057190 A 5/2015
KR 10-2016-0028597 A 3/2016

* cited by examiner

PIXEL SENSING DEVICE AND PANEL DRIVING DEVICE

TECHNICAL FIELD

The present disclosure relates to a technology for driving a display device.

BACKGROUND ART

Display devices include a source driver for driving pixels disposed on a panel.

The source driver determines a data voltage in accordance with image data and controls the brightness of each pixel by supplying the data voltage to the pixels.

Meanwhile, the brightness of each pixel may be different due to the characteristics of the pixels even if the same data voltage is supplied. For example, a pixel includes a driving transistor, and when the threshold voltage of the driving transistor changes, the brightness of the pixel changes even if the same data voltage is supplied. When the source driver does not consider this characteristic change of pixels, a problem that the pixels are driven with undesired brightness and the image quality is deteriorated may be generated.

In detail, the characteristics of pixels change in accordance with time or the surrounding environment. When a source driver supplies a data voltage without considering changed characteristics of pixels, a problem of deterioration of image quality, for example, burn-in is generated.

In order to solve this problem of deterioration of image quality, display devices may include a pixel sensing device that senses characteristics of pixels.

A pixel sensing device can receive an analog signal for each pixel through sensing lines respectively connected to the pixels. Further, the pixel sensing device converts the analog signal into pixel sensing data and transmits the pixel sensing data to a timing controller and the timing controller finds out the characteristics of each pixel from the pixel sensing data. Further, the timing controller can suppress the problem of deterioration of image quality due to differences among pixels by compensating for image data by reflecting the characteristics of the pixels.

Meanwhile, the pixel sensing device may include a plurality of channel circuit to measure many pixels, for example, over thousands of pixels, disposed on a panel within short time. However, these channel circuits have differences, depending on the manufacturing process or the surrounding environment, which deteriorates the accuracy in sensing.

DETAILED DESCRIPTION OF THE INVENTION

Technical Problem

Under this background, an aspect of the present disclosure is to provide a technology for compensating for differences existing among channel circuits of a pixel sensing device.

In view of the foregoing, in an aspect, the present disclosure provides a pixel sensing device that senses currents of pixels disposed on a display panel, the pixel sensing device comprising: a plurality of channel circuits, each of which generates a first sensing data by sensing a first current supplied from a test current source in a first mode, and generates a second sensing data by sensing a third current obtained by combining a second current supplied from the test current source and a pixel current transmitted from each of the pixels in a second mode; and a data transmitting part that transmits the first sensing data and the second sensing data to a data processing circuit, in which the data processing circuit recognizes sensing errors of each of the channel circuits using the first sensing data, compensates for the second sensing data using the sensing errors, and compensates for image data in accordance with a characteristic of each of the pixels found out in accordance with the second sensing data.

Each of the channel circuits may comprise: a current combining part that generates the third current by combining the second current supplied from the test current source and the pixel current; a first selecting part that selectively output the first current or the third current; and a second selecting part that outputs the first current supplied from the test current source to the first selecting part in the first mode and outputs the second current supplied from the test current source to the current combining part in the second mode. Further, the first selecting part and the second selecting part may be synchronized with a control signal received from the data processing circuit to operate.

Each of the channel circuits may comprise: an analog-front-end part that receives the first current in the first mode and receives the third current in the second mode; and an analog-digital-converting part that generates the first sensing data in the first mode and generates the second sensing data in the second mode by converting an output signal of the analog-front-end part into digital data, in which at least two or more channel circuits may have different offset errors of the analog-front-end parts or the analog-digital-converting parts. Further, the analog-front-end may include an amplifier, a capacitor connected between an input terminal and an output terminal of the amplifier, and a reset switch connected in parallel to the capacitor, and may transmit an integral value of an input current to the analog-digital-converting part.

The pixel sensing device may comprise a current combining part that combines a current transmitted to a first input terminal and a current transmitted to a second input terminal and outputs a combined current, in which the first input terminal may be connected to each of the pixels through a switch and the switch may be opened in the first mode and may be closed in the second mode.

A driving transistor and an organic light emitting diode may be disposed to be connected to a first node in each of the pixels, and a driving current that is supplied to the organic light emitting diode may be controlled by the driving transistor. Further, the pixel current may be a current that is transmitted to the first node through the driving transistor or a current that flows to the organic light emitting diode through the first node. Further, the pixel sensing device may further comprise a data driving circuit that supplies a data voltage according to image data to a gate node of the driving transistor.

In another aspect, the present disclosure provides a pixel sensing device that senses currents of pixels disposed on a display panel, the pixel sensing device including: a plurality of channel circuits, each of which generates a first sensing data by sensing a first current supplied from a test current source in a first mode, and generates a second sensing data by sensing a third current obtained by combining a second current supplied from the test current source and a pixel current transmitted from each pixel in a second mode; a memory that stores the first sensing data and the second sensing data; a difference compensating part that recognizes a sensing error of each of the channel circuits using the first sensing data and compensates for the second sensing data using the sensing error; and a data transmitting part that transmits the compensated second sensing data to a data processing circuit that compensates for image data in accordance with a characteristic of each of the pixels.

A driving transistor and an organic light emitting diode may be disposed to be connected to a first node in each of the pixels, and a driving current that is supplied to the organic light emitting diode may be controlled by the driving transistor. Further, the pixel current may be a current that is transmitted to the first node through the driving transistor or a current that flows to the organic light emitting diode through the first node. Further, the pixel sensing device may further comprise a data driving circuit that supplies a data voltage according to image data to a gate node of the driving transistor.

According to the present disclosure described above, it is possible to compensate for differences existing among channel circuits of a pixel sensing device.

MODE FOR CARRYING OUT THE INVENTION

Figure 1:
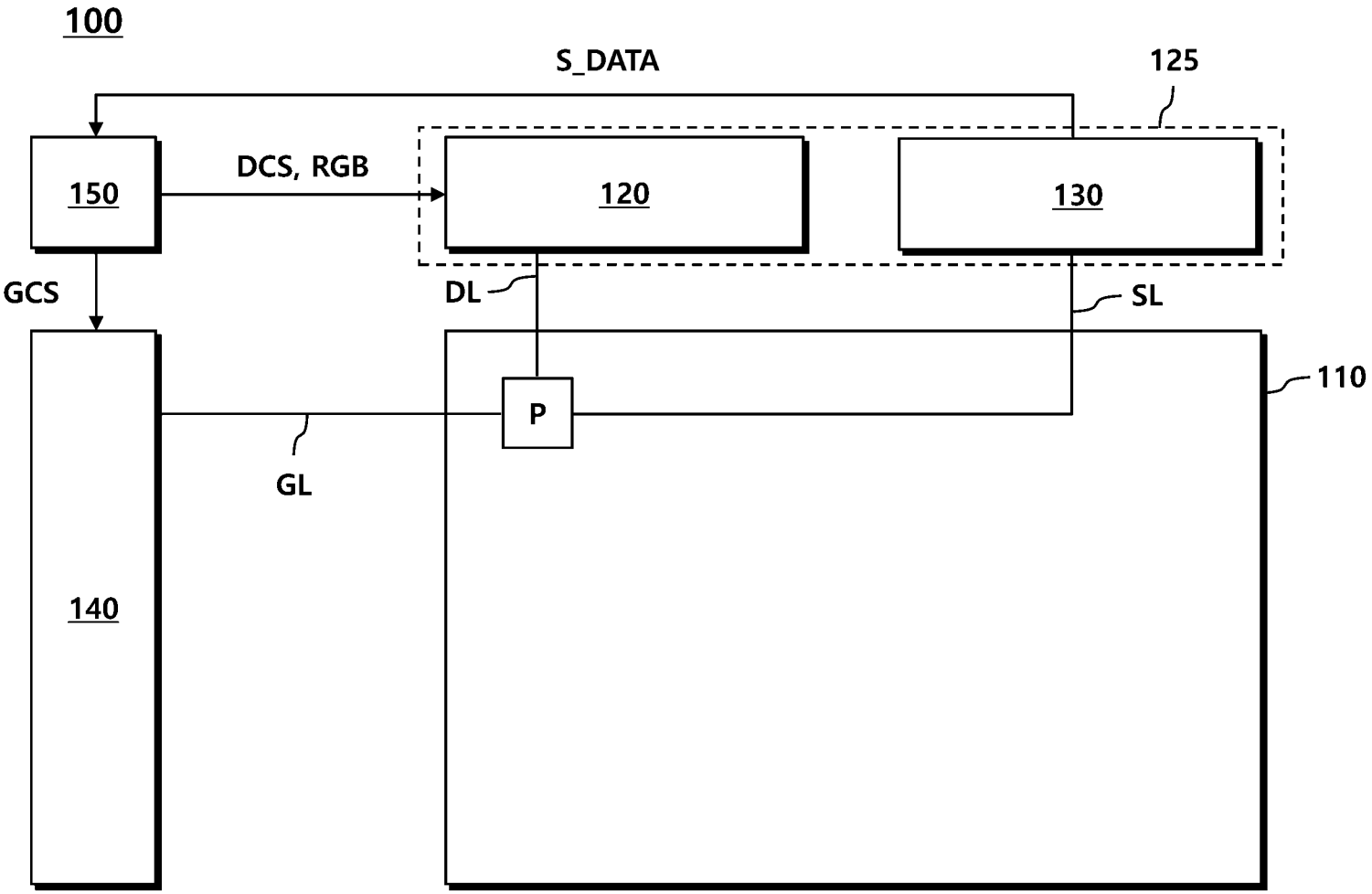
FIG. 1 is a diagram showing the configuration of a display device according to an embodiment.

Hereinafter, embodiments of the present disclosure are described in detail with reference to exemplary drawings. It should be noted that when components are given reference numerals in the drawings, the same components are given the same reference numerals even if they are shown in different drawings. Further, in the description of the present disclosure, well-known functions or constructions will not be described in detail when it is determined that they may unnecessarily obscure the spirit of the present disclosure.

Terms 'first', 'second', 'A', 'B', '(a)', and '(b)' can be used in the following description of the components of the present disclosure. The terms are only for discriminating a component from another component and the substance, sequence, or order of corresponding components is not limited by the terms. When a component is described as being "connected", "combined", or "coupled" with another component, it should be understood that the component may be connected, combined, or coupled to another component directly or with another component interposing therebetween.

FIG. 1 is a diagram showing the configuration of a display device according to an embodiment.

Referring to FIG. 1, a display device 100 may include a panel 110 and panel driving devices 120, 130, 140, and 150 that drive the panel 110.

A plurality of data lines DL, a plurality of gate lines GL, and a plurality of sensing lines SL are disposed and a plurality of pixels P may be disposed on the panel 110.

The devices 120, 130, 140, and 150 that drive at least one component included in the panel 110 can be referred to as panel driving devices. For example, a data driving circuit 120, a pixel sensing circuit 130, a gate driving circuit 140, a data processing circuit 150, etc. can be referred to as panel driving circuits.

Each of the circuits 120, 130, 140, and 150 may be referred to as a panel driving circuit, and the whole or a plurality of circuits may be referred to as a panel driving circuit.

In the panel driving devices, the gate driving circuit 140 can supply a scan signal of a turn-on voltage or a turn-off voltage to the gate lines GL. When a scan signal of the turn-on voltage is supplied to a pixel P, the pixel P is connected with the data line DL, and when a scan signal of the turn-off voltage is supplied to the pixel P, the pixel P and the data line DL are disconnected.

In the panel driving devices, the data driving circuit 120 supplies a data voltage to the data lines DL. The data voltage supplied to the data lines DL is transmitted to the pixels P connected to the data lines DL in response to a scan signal.

In the panel driving devices, the pixel sensing circuit 130 receives signals, for example, a voltage and a current, generated in the pixels P. The sensing circuit 130 may be connected to the pixels P in response to a scan signal or may be connected to the pixels P in response to a separate sensing gate signal. The separate sensing gate signal can be generated by the gate driving circuit 140.

In the panel driving devices, the data processing circuit 150 can supply various control signals to the gate driving circuit 140 and the data driving circuit 120. The data processing circuit 150 can generate and transmit a gate control signal GCS, which starts scanning at a timing implemented at each frame, to the gate driving circuit 140. Further, the data processing circuit 150 can output image data RGB converted from image data input from the outside to fit to the data signal form that is used in the data driving circuit 120, to the data driving circuit 120. Further, the data processing circuit 150 can transmit a data control signal DCS that controls the data driving circuit 120 to supply a data voltage to the pixels P at each timing.

The data processing circuit 150 can compensate for and transmit the image data RGB in accordance with the characteristics of the pixels P. The data processing circuit 150 can receive sensing data S_DATA from the pixel sensing circuit 130. Measured values for the characteristics of the pixels P may be included in the sensing data S_DATA.

Meanwhile, the data driving circuit 120 may be referred to as a source driver. Further, the gate driving circuit 140 may be referred to as a gate driver. Further, the data processing circuit 150 may be referred to as a timing controller. The data driving circuit 120 and the pixel sensing circuit 130 may be included in one integrated circuit 125 and may be referred to as a source driver IC (Integrated Circuit). Further, the data driving circuit 120, pixel sensing circuit 130, and data processing circuit 150 may be included in one integrated circuit and may be referred to as, in combination, an integrated IC. This embodiment is not limited to these names, but some components generally known in a source driver, a gate driver, and a timing controller are not described in the following description. Accordingly, it should be considered that some components are not provided when understanding embodiments.

Meanwhile, the panel 110 may be an organic light emitting display panel. The pixels P disposed on the panel 110 each may include an organic light emitting diode OLED and one ore more transistors. The characteristics of the organic light emitting diode OLED and the transistor included in each pixel P may depend on time or a surrounding environment. The pixel sensing circuit 130 according to an embodiment can sense and transmit the characteristics of the components included in each pixel P to the data processing circuit 150.

Figure 2:
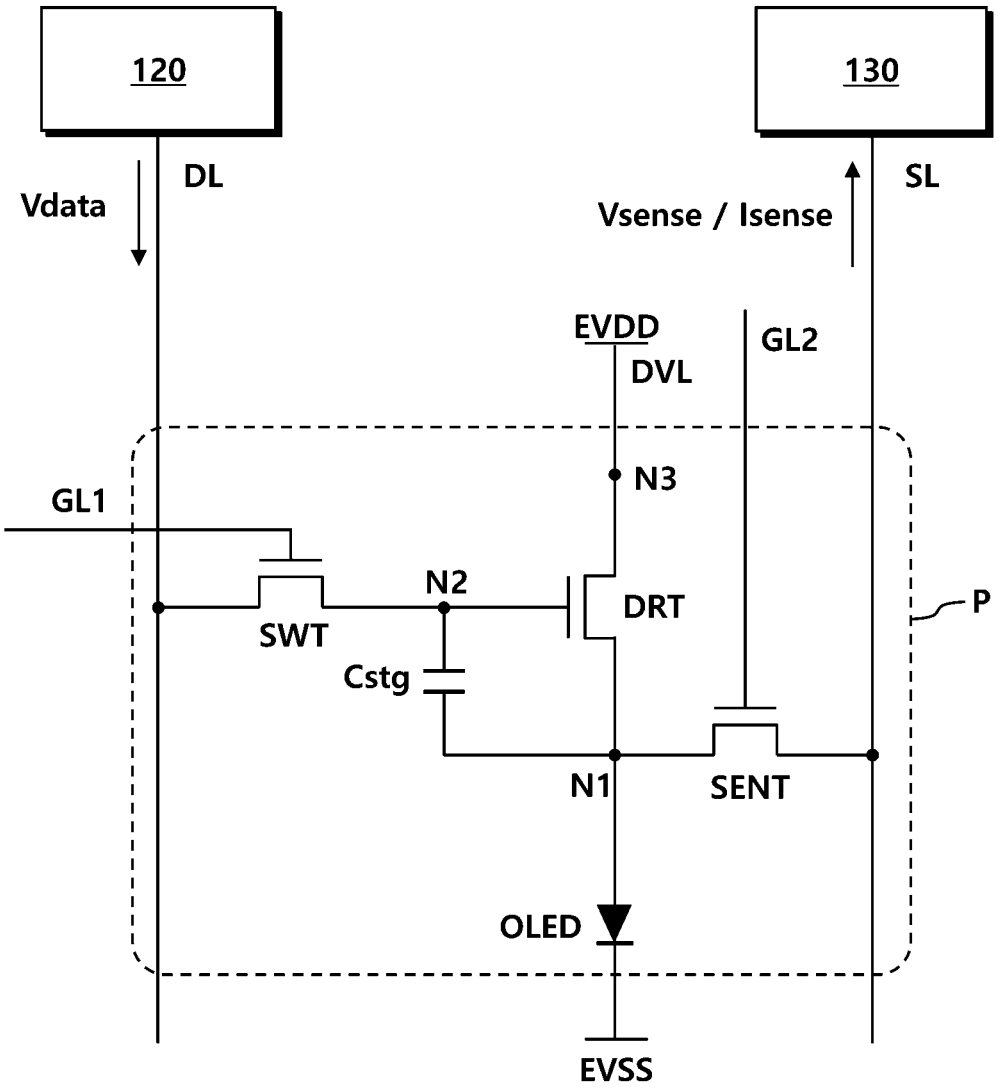
FIG. 2 is a diagram showing the structure of each of the pixels of FIG. 1 and signals input/output to a pixel from a data driving circuit and a pixel sensing circuit.

FIG. 2 is a diagram showing the structure of each of the pixels of FIG. 1 and signals input/output to a pixel from a data driving circuit and a pixel sensing circuit.

Referring to FIG. 2, a pixel P may include an organic light emitting diode OLED, a driving transistor DRT, a switching transistor SWT, a sensing transistor SENT, a storage capacitor Cstg, etc.

The organic light emitting diode OLED may include an anode, an organic layer, a cathode, etc. The anode is controlled to be connected to a driving voltage EVDD by the driving transistor DRT and the cathode is controlled to be connected to a base voltage EVSS, thereby emitting light.

The driving transistor DRT can control the brightness of the organic light emitting diode OLED by controlling a driving current that is supplied to the organic light emitting diode OLED.

A first node N1 of the driving transistor DRT may be electrically connected to the anode of the organic light emitting diode OLED, and it may be a source node or a drain node. A second node N2 of the driving transistor DRT may be electrically connected to a source node or a drain node of the switching transistor SWT, and it may be a gate node. A third node N3 of the driving transistor DRT may be electrically connected to a driving voltage line DVL for supplying a driving voltage EVDD, and it may be a drain node or a source node.

The switching transistor SWT is electrically connected between the data line DL and the second node N2 of the driving transistor DRT and can be turned on in response to a scan signal that is supplied through the gate lines GL1 and GL2.

When the switching transistor SWT is turned on, a data voltage Vdata supplied from the data driving circuit 120 through the data line DL is transmitted to the second node N2 of the driving transistor DRT.

The storage capacitor Cstg may be electrically connected between the first node N1 and the second node N2 of the driving transistor DRT.

The storage capacitor Cstg may a parasitic capacitor existing between the first node N1 and the second node N2 of the driving transistor DRT and may be an external capacitor intentionally designed outside the driving transistor DRT.

The sensing transistor SENT can connect the first node N1 of the driving transistor DRT to the sensing line SL and the sensing line SL can transmit a reference voltage to the first node N1 and can transmit an analog signal, for example, a voltage or a current, generated at the first node N1 to the pixel sensing circuit 130.

Further, the pixel sensing circuit 130 measure the characteristics of the pixels P using an analog signal Vsense or Isense transmitted through the sensing line SL.

It is possible to find out the threshold voltage, mobility, a current characteristic, etc. of the driving transistor DRT by measuring the voltage of the first node N1. Further, it is possible to find out the degree of deterioration of the organic light emitting diode OLED such as parasitic capacitance, a current characteristic, etc. of the organic light emitting diode OLED by measuring the voltage at the first node N1.

Further, it is possible to measure the current ability of the driving transistor DRT by measuring the current that is transmitted to the first node N1 through the driving transistor DRT. Further, it is possible to measure the current characteristic of the organic light emitting diode OLED by measuring the current that flows to the organic light emitting diode OLED through the first node N1.

The pixel sensing circuit 130 can measure a current that is transmitted from or transmitted to the first node N1 and can transmit the measured value to the data processing circuit (see 150 in FIG. 1). Further, the data processing circuit (see 150 in FIG. 1) can find out the characteristics of the pixels P by analyzing the current.

Figure 3:
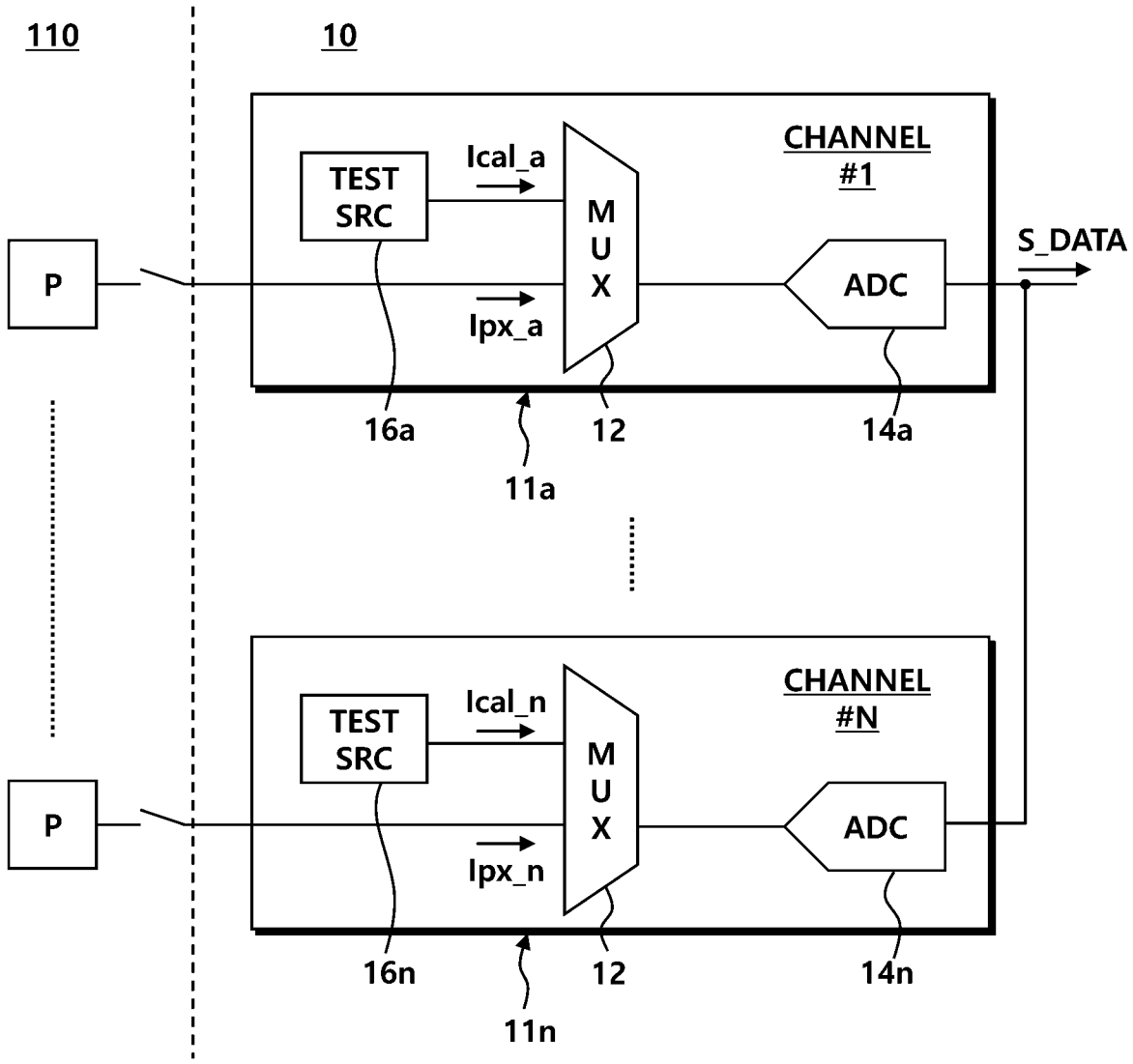
FIG. 3 is a diagram showing an exemplary configuration of a pixel sensing circuit.

FIG. 3 is a diagram showing an exemplary configuration of a pixel sensing circuit.

Referring to FIG. 3, the pixel sensing circuit 10 includes a plurality of channel circuits 11*a*, . . . , 11*n* and the channel circuits 11*a*, . . . , 11*n* can sense pixel currents Ipx_a, . . . , Ipx_n transmitted from the pixels through analog-digital-converting (ADC) parts 14*a*, . . . , 14*n*, respectively. Further, the sensing circuit 10 can transmit sensing data S_DATA corresponding to the sensed pixel currents Ipx_a, . . . , Ipx_n to the data processing circuit.

The channel circuits 11*a*, . . . , 11*n* may include separate ADCs 14*a*, . . . , 14*n*, respectively. However, the ADCs 14*a*, . . . , 14*n* respectively included in the channel circuits 11*a*, . . . , 11*n* may have different characteristics due to difference in manufacturing process or differences in surrounding environment condition. Further, the channel circuits 11*a*, . . . , 11*n* may respectively sense the same pixel currents Ipx_a, . . . , Ipx_n as different values due to the characteristic differences of the ADCs 14*a*, . . . , 14*n*.

The pixel sensing circuit 10 may further include test current sources 16*a*, . . . , 16*n* respectively in the channel circuits 11*a*, . . . , 11*n* to compensate sensing errors of the channel circuits 11*a*, . . . , 11*n*. When the pixel sensing circuit 10 is operated in a test mode, a current according to a predetermined value is output from the test current sources 16*a*, . . . , 16*n*, and the data processing circuit calculates a sensing error of each of the channel circuits 11*a*, . . . , 11*n* by comparing the values sensed in the test mode with a predetermined value. Further, the data processing circuit obtains sensing values compensated by reflecting the sensing errors from the values sensed in the sensing mode.

However, when there is an error in the test current sources 16*a*, . . . , 16*n* themselves, the efficiency of this sensing error compensation method decreases.

TABLE 1

| Channel | Actual pixel current value (Ipx) | Test current source error (ΔIcal) | Error of analog-digital-converting part (ΔADC) | Sensing error of channel circuit (ΔIca1 + ΔADC) | Sensing value before pixel current compensation | Sensing value after pixel current compensation |
|---|---|---|---|---|---|---|
| 1 | 100 | −3 | 2 | −1 | 102 | 103 |
| . . . | | | | | | |
| N | 90 | −3 | 4 | 1 | 94 | 93 |

Referring to Table 1, the first test current source 16*a* included in the first channel circuit 11*a* may have an offset error of −3. Further, the first analog-digital-converting part 14*a* may have an offset error of 2. However, the data processing circuit has difficulty in discriminating errors of the first test current source 16*a* and the first analog-digital-converting part 14*a*, so it can recognize the sensing error of the first channel circuit 11*a* as −1. Further, when the sensing value for the first pixel current Ipx_a is determined as 102 in the sensing mode, the data processing circuit can recognize the first pixel current Ipx_a as 103 by reflecting a sensing error of −1 to the sensing value 102. If the data processing circuit reflected only the error of 2 of the analog-digital-converting part 14*a* to the sensing value of 102 in the sensing mode, the first pixel current Ipx_a could be recognized as 100 the same as the actual value, but an error of −3 of the first test current source 16*a* was additionally reflected in sensing value compensation, so 103 that is different from the actual value was recognized.

Since errors are generated not only in the analog-digital-converting parts 14*a*, . . . , 14*n*, but also in the test current sources 16*a*, . . . , 16*n*, there is a problem in the sensing error compensation method described above with reference to FIG. 3 that the data processing circuit cannot obtain accurate sensing values for the pixel currents Ipx_a, . . . , Ipx_n.

Figure 4:
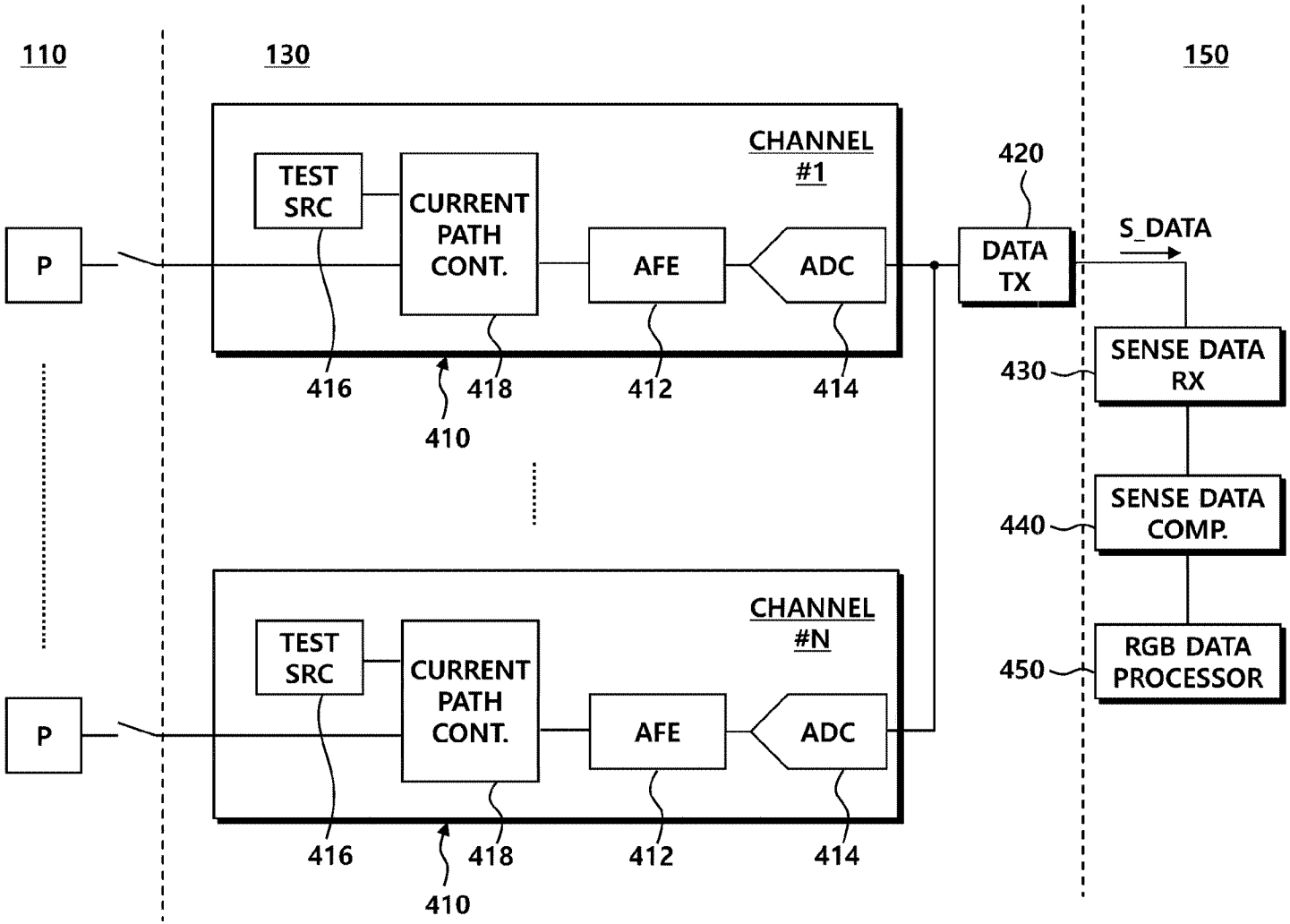
FIG. 4 is a diagram showing the internal configuration of a pixel sensing circuit and a data processing circuit according to an embodiment.

FIG. 4 is a diagram showing the internal configuration of a pixel sensing circuit and a data processing circuit according to an embodiment.

Referring to FIG. 4, a plurality of pixels P may be disposed on the panel 110. Further, the pixel sensing circuit 130 may include a plurality of channel circuits 410 sensing a plurality of pixels P, a data transmitting part 420, etc. Further, the data processing circuit 150 may include a data receiver 430, a sensing data compensating part 440, an image data processor 450, etc.

The channel circuits 410 each may include an Analog-Front-End (AFE) 412, an Analog-Digital-Convert (ADC) 414, a test current source 416, a current path controlling part 418, etc.

The analog-front-end 412 can process an analog signal, for example, a current that is transmitted to an input end.

The analog-digital-converting part 414 can convert an output signal of the analog-front-end 412 into digital data.

Further, the data transmitting part 420 can transmit digital data transmitted from the analog-digital-converting part 414 to the outside, for example, the data processing circuit 150.

Meanwhile, since the pixels P are disposed on the panel 110, the pixel sensing circuit 130 may include several channel circuits 410 to sense the many pixels P within short time. The channel circuits 410 each sense at least one pixel P disposed on the panel 110 simultaneously in parallel, thereby reducing the sensing time for all the pixels P.

However, since a plurality of channel circuits 410 is included in the pixel sensing circuit 130, there may be a problem in that a difference is generated among the channel circuits 410.

The channel circuit 410 each may include the test current source 416 to compensate for the differences of the channel circuits 410. The test current source 416 can supply a test current to the analog-front-end 412.

Further, the data processing circuit 150 can compensate for the differences of the channel circuits 410, for example, differences in sensing offset value using the digital data created by the test current.

The data receiver 430 of the data processing circuit 150 can receive digital data-sensing data S_DATA-transmitted from the data transmitting part 420 and the data compensating part 440 can compensate for the differences of each of the channel circuits 410 using the received sensing data S_DATA.

When completing compensating differences for the channel circuits 410, the sensing data compensating part 440 can apply a compensate value, for example, a sensing offset compensation value to the sensing data S_DATA transmitted later and transmit the sensing data to the image data processor 450.

Further, the image data processor 450 can find out the characteristics of the pixels P using the compensated sensing data and can compensate for image data to fit to the characteristics of the pixels P.

Meanwhile, the pixel sensing circuit 130 may further include the current path controlling part 418 to reflect the error of the test current source 416.

The current path controlling part 418 can transmit a first current supplied from the test current source 416 to a rear end, for example, the analog-front-end 412 and the analog-digital-converting part 414 in a first mode, for example, a test mode, and can transmit a third current obtained by combining a second current supplied from the test current source 416 and a pixel current transmitted from each pixel P to the rear end in a second mode, for example, a sensing mode.

Further, the analog-digital-converting part 414 can create first sensing data corresponding to the first current in the first mode and can create second sensing data corresponding to the third current in the second mode. Further, the data processing circuit 150 can create a sensing error value of each channel circuit using the first sensing data and can compensate for the second sensing data using the sensing error values.

Considering the principle, an error of the test current source 416 and errors of other components, for example, the analog-front-end 412 and the analog-digital-converting part 414 of the channel circuit 410 may be included in the sensing error values found out through the first sensing data. However, the pixel sensing circuit 130 generates the same error generation condition as in the first mode when creating the second sensing data, thereby being able to increase accuracy of compensation by the sensing error values found out through the first sensing data. In detail, a current supplied from the test current source 416 is included together with the pixel current in the second sensing data, so the error of the test current source 416 and errors of other components of the channel circuit 410 are included in the second sensing data. Since the same error is included also in the sensing error values found out through the first sensing data, the data processing circuit 150 can more accurately perform compensation by applying the sensing error values to the second sensing data.

Figure 5:
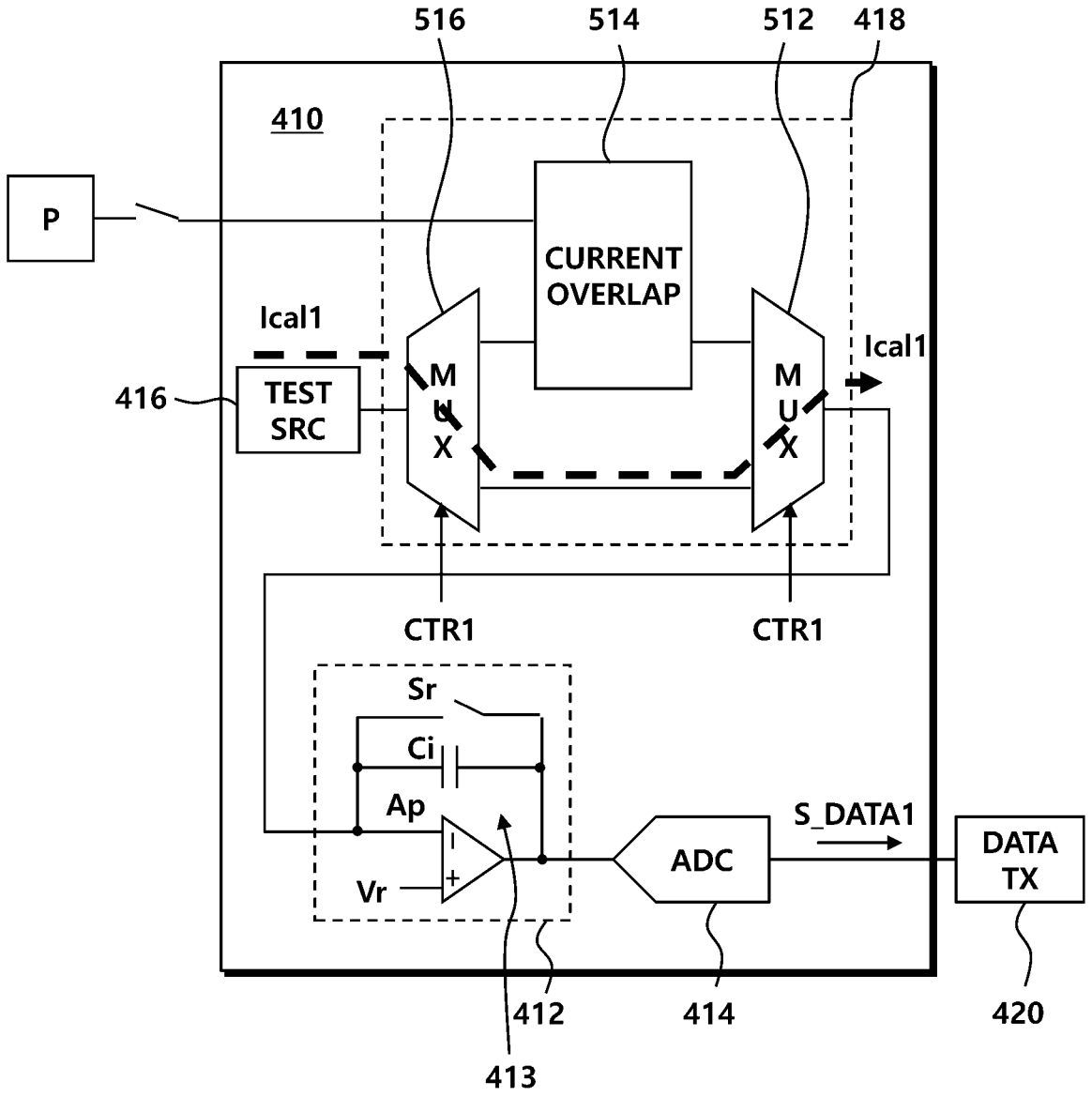
FIG. 5 is a diagram showing current flow in a first mode in a channel circuit according to an embodiment.
Figure 6:
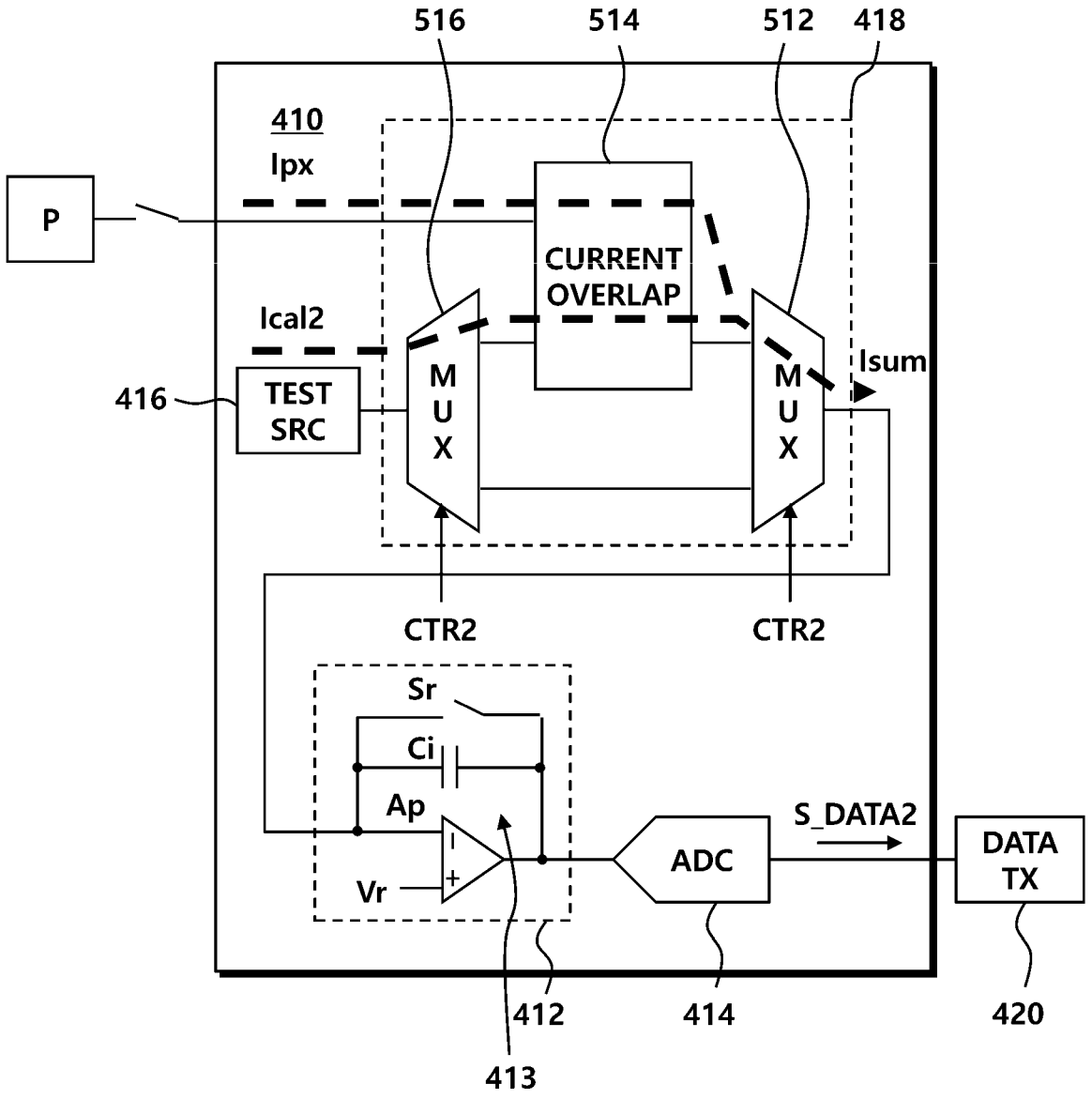
FIG. 6 is a diagram showing current flow in a second mode in a channel circuit according to an embodiment.

FIG. 5 is a diagram showing current flow in a first mode in a channel circuit according to an embodiment and FIG. 6 is a diagram showing current flow in a second mode in a channel circuit according to an embodiment.

Referring to FIGS. 5 and 6, the current path controlling part 418 may include a first selecting part 512, a current combining part 514, a second selecting part 516, etc.

The second selecting part 516 can output a current transmitted from the test current source 416 selective to the current combining part 514 or the first selecting part 512.

In the first mode, the second selecting part 516 can output a first current Ical1 transmitted from the test current source 416 to the first selecting part 512. Further, in the second mode, the second selecting part 516 can output a second current Ical2 transmitted from the test current source 416 to the current combining part 514.

The first selecting part 512 can selectively output a current output from the second selecting part 516 or a current output from the current combining part 514. In the first mode, the first selecting part 512 can output the first current Ical1 output from the second elector 516. Further, in the second mode, the first selecting part 512 can output the current output from the current combining part 514.

The current combining part 514 can create a third current Isum by combining the current supplied from the test current source 416 and the pixel currents Ipx transmitted from the pixels P. Further, the current combining part 514 can output the third current Isum to the first selecting part 512. The current combining part 514 may be connected to the test current source 416 through the second selecting part 516.

In the first mode, the current combining part 514 may not be supplied with a current from the test current source 416. In this case, the second selecting part 516 can transmit the current supplied from the test current source 416 to the first selecting part 512. In the first mode, the current combining part 514 may not be supplied with the pixel currents Ipx from the pixels P. In this case, a switch disposed between the pixel P and the current combining part 514 is opened, so the pixel currents Ipx may not be supplied to the current combining part 514. In the first mode, the current combining part 514 may not output a current to the first selecting part 512.

In the second mode, the current combining part 514 can create the third current Isum by combining the second current Ical2 supplied from the test current source 416 and the pixel current Ipx transmitted from each pixel P and can output the third current Isum to the first selecting part 512.

The first selecting part 512 and the second selecting part 516 may be synchronized with control signals CTR1 and CTR2, received from the data processing circuit, to operate. For example, the first selecting part 512 and the second selecting part 516 may be operated in the first mode in accordance with the first control signal CTR1, and the first selecting part 512 and the second selecting part 516 may be operated in the second mode in accordance with the second control signal CTR2.

The analog-front-end 412 can output an analog signal by pre-processing the current output from the first selecting part 512.

The analog-front-end 412 may include an integrator 413. Further, the integrator 413 may include an amplifier Ap, a capacitor Ci connected between an input terminal, for example, a minus input terminal and an output terminal of the amplifier Ap, a reset switch Sr connected in parallel to the capacitor Ci, etc.

The current output from the first selecting part 512 is integrated through the capacitor Ci and an integral value of a current signal can be transmitted to the analog-digital-converting part 414. The value integrated through the capacitor Ci can be reset by the reset switch Sr in the next measurement.

The amplifier Ap, the capacitor Ci, etc. included in the analog-front-end 412 may generate an offset error in an output analog signal, depending on characteristics. Further, the offset error may be included in sensing data that is created through the analog-digital-converting part 414.

The analog-digital-converting part 414 can create sensing data by converting an analog signal output from the analog-front-end 412.

The analog-digital-converting part 414 can create first sensing data S_DATA1 corresponding to the first current Ical1 in the first mode and can create second sensing data S_DATA2 corresponding to the third current Isum in the second mode. Further, the data transmitting part 420 can transmit the first sensing data S_DATA1 and second sensing data S_DATA2 to the data processing circuit.

The data processing circuit can create a sensing error value of each channel circuit 410 using the first sensing data S_DATA1 and can compensate for the second sensing data S_DATA2 using the sensing error values.

TABLE 2

| Channel | Actual pixel current value (Ipx) | Test current source error (ΔIcal) | Error of analog-digital-converting part (ΔADC) | Sensing error of channel circuit (ΔIca1 + ΔADC) | Sensing value before pixel current compensation | Sensing value after pixel current compensation |
|---|---|---|---|---|---|---|
| 1 | 100 | −3 | 2 | −1 | 99 | 100 |

Referring to Table 2, the test current source 416 included in the channel circuit 410 may have an offset error of −3. Further, the analog-digital-converting part 414 may have an offset error of 2. However, the data processing circuit has difficulty in discrimination the errors of the test current source 416 and the analog-digital-converting part 414, so it may recognize the sensing error of the channel circuit 410 as −1. The data processing circuit can recognize the sensing error of the channel circuit by receiving the first sensing data S_DATA1 in the first mode.

In the second mode, the data processing circuit can receive the second sensing data S_DATA2 corresponding to the third current Isum obtained by combining the current supplied from the test current source 416 and the pixel current. Not only the errors of components of the sensing part of the channel circuit 410, for example, the analog-front-end 412 and the analog-digital-converting part 414, but the error of the test current source 416 is included in the sensing value of 99 included in the second sensing data S_DATA2. Accordingly, it is possible to accurately find out a pixel current of 100 by applying the sensing error of −1 recognized in the first mode to the second sensing data S_DATA2.

Figure 7:
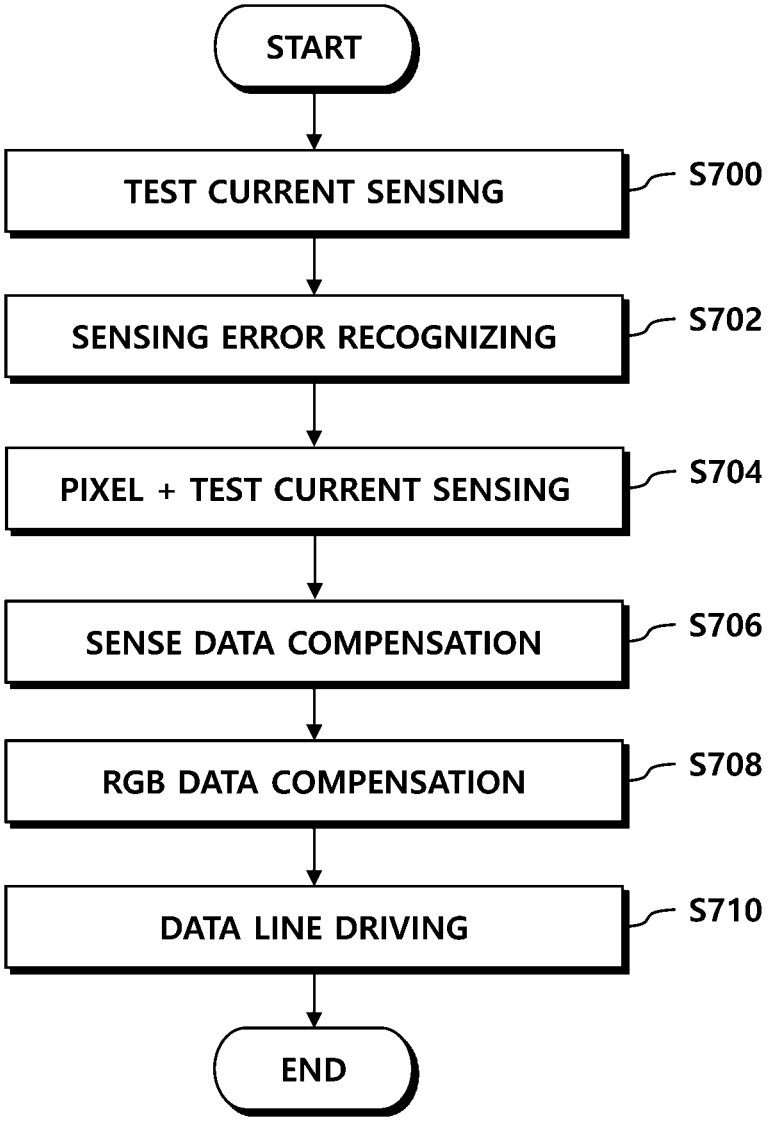
FIG. 7 is a flowchart of a panel driving method according to an embodiment.

FIG. 7 is a flowchart of a panel driving method according to an embodiment.

Referring to FIG. 7, the pixel sensing circuit can create first sensing data by sensing a first current that is supplied from the test current source and can transmit the first sensing data to the data processing circuit (Step S700).

The data processing circuit can recognize the sensing error of each channel circuit by comparing the sensing value of the first current included in the first sensing data with a predetermined sensing value for the first current (Step S702).

Further, the pixel sensing circuit can create and transmit second sensing data to the data processing circuit by sensing a third current obtained by combining a second current supplied from the test current source and the pixel current transmitted from each pixel (Step S704).

The data processing circuit can obtain a sensing value for the pixel current by subtracting a predetermined sensing value for the second current from the sensing value of the third current included in the second sensing data. Further, the data processing circuit can obtain a sensing value compensated for the pixel current by applying the sensing values of the channel circuits-sensing error of each channel recognized in accordance with the first sensing data-to the sensing value for the pixel current (Step S706).

Further, the data processing circuit can compensate for image data in accordance with the characteristics of the pixels found out in accordance with the sensing values compensated for the second sensing data (Step S708).

Further, the data driving circuit can drive each data line using the compensated image data (Step S710).

On the other hand, it was described that only digital data is created by sensing each pixel-sensing data for pixels are created-in the pixel sensing circuit and compensation for digital data is performed by the data processing circuit. However, depending on embodiments, the pixel sensing circuit may perform compensation for the digital data and transmit the compensated sensing data to the data processing circuit.

Figure 8:
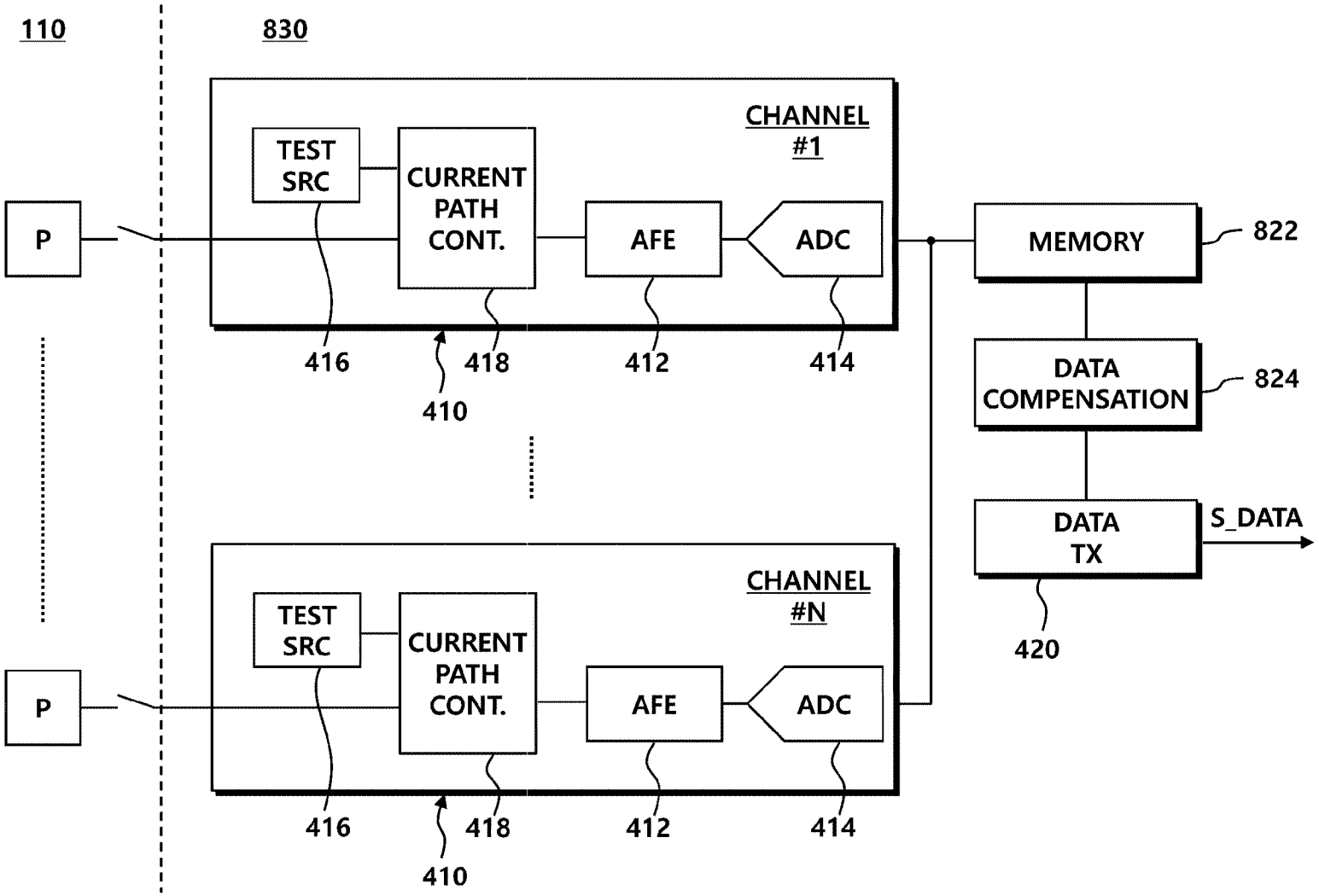
FIG. 8 is a diagram showing the internal configuration of a pixel sensing circuit according to another embodiment.

FIG. 8 is a diagram showing the internal configuration of a pixel sensing circuit according to another embodiment.

Referring to FIG. 8, a pixel sensing circuit 830 includes a plurality of channel circuits 410, a memory 822, a difference compensating part 824, a data transmitting part 420, etc.

Each channel circuit 410 may include an analog-front-end 412, an analog-digital-converting part 414, a test current source 416, a current path controlling part 418, etc.

Each channel circuit 410 can create first sensing data by sensing a first current that is supplied from the test current source 416 in a first mode, and can create second sensing data by sensing a third current obtained by combining a second current that is supplied from the test current source 416 and a pixel current transmitted from each pixel in a second mode.

The memory 822 can store digital data-first sensing data and second sensing data-output from each channel circuit 410.

The difference compensating part 824 can recognize the sensing error of each channel 410 using the first sensing data and can compensate for the second sensing data using the recognized sensing errors.

Further, the data transmitting part 420 can transmit the compensated second sensing data as sensing data S_DATA to the data processing circuit.

In this embodiment, the data processing circuit can find out the characteristic of each pixel directly using the sensing data S_DATA without a separate sensing value compensation process.

Figure 9:
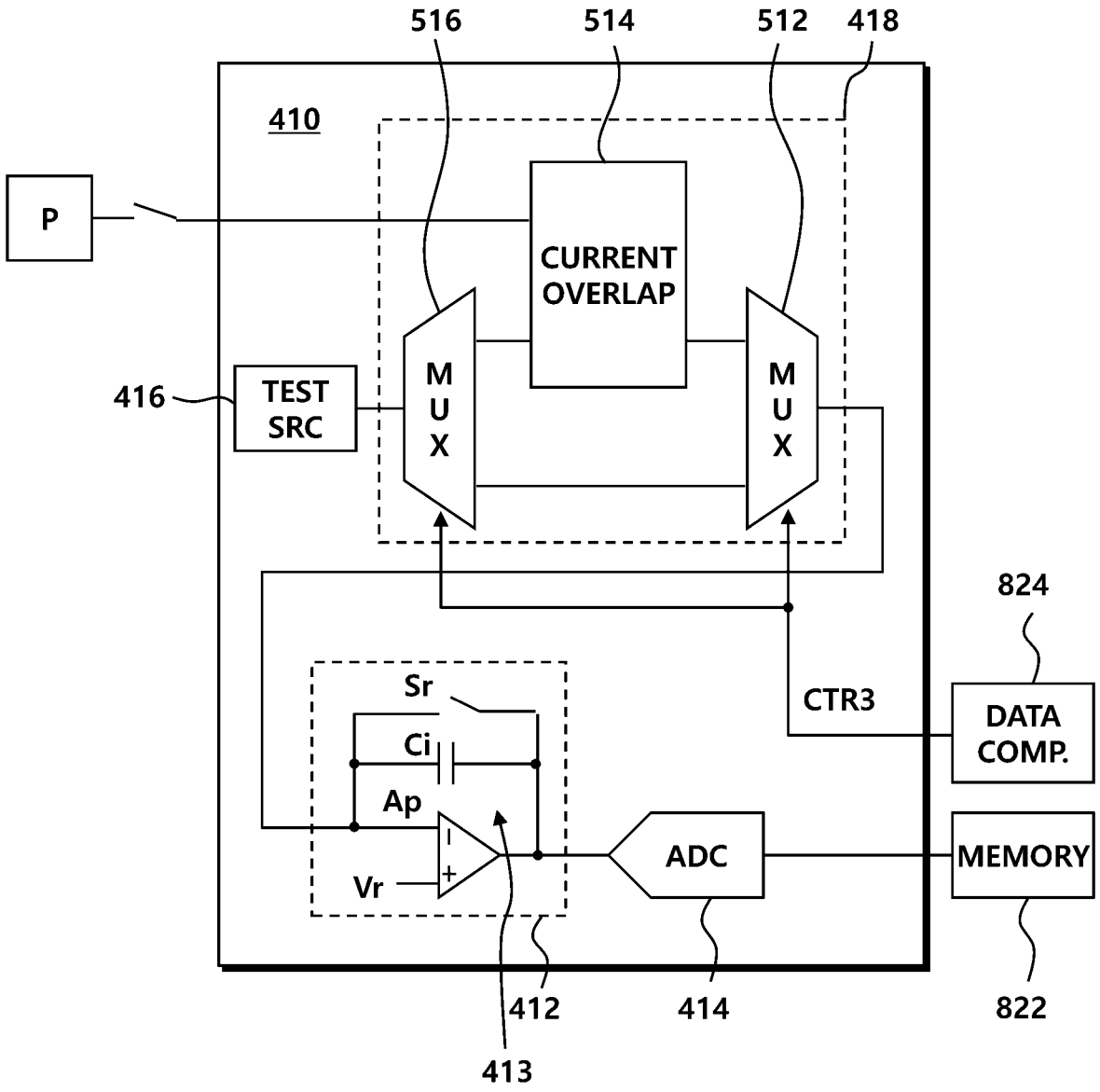
FIG. 9 is a diagram showing the configuration of a channel circuit according to another embodiment.

FIG. 9 is a diagram showing the configuration of a channel circuit according to another embodiment.

Referring to FIG. 9, the current path controlling part 418 may include a first selecting part 512, a current combining part 514, a second selecting part 516, etc.

Further, the analog-front-end 412 may include an integrator 413. Further, the integrator 413 may include an amplifier Ap, a capacitor Ci connected between an input terminal, for example, a minus input terminal and an output terminal of the amplifier Ap, a reset switch Sr connected in parallel to the capacitor Ci, etc.

The analog-digital-converting part 414 can convert an analog signal output from the analog-front-end 412 in to digital data and store the digital data in the memory 822.

In the current path controlling part 418, the first selecting part 512 and the second selecting part 516 can be synchronized with a control signal CTR3, generated inside the pixel sensing circuit 830, for example, in the difference compensating part 824, to operate. The first selecting part 512 and the second selecting part 516 can be operated in the first mode or the second mode in accordance with the control signal CTR3.

Meanwhile, the current path controlling part may not include the first selecting part and the second selecting part, depending on embodiments.

Figure 10:
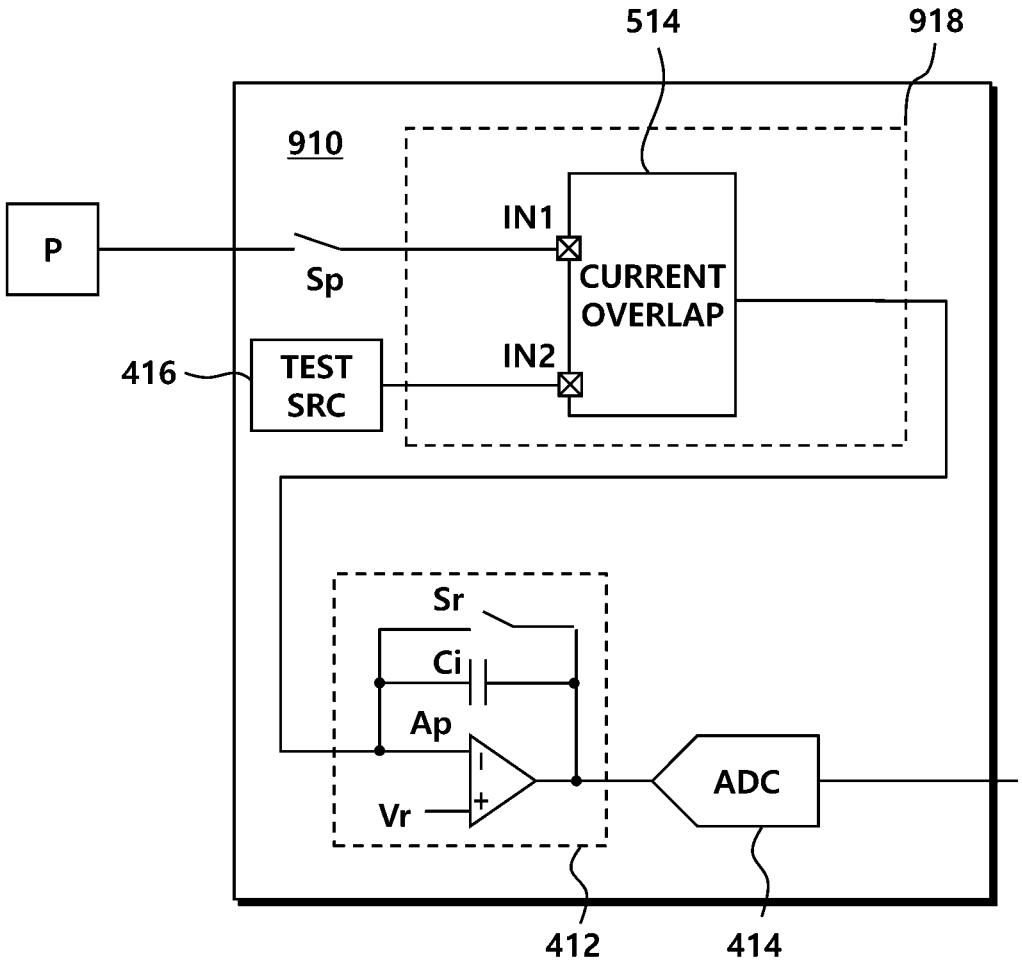
FIG. 10 is a diagram showing the configuration of a channel circuit according to another embodiment.

FIG. 10 is a diagram showing the configuration of a channel circuit according to another embodiment.

Referring to FIG. 10, a channel circuit 910 may include an analog-front-end 412, an analog-digital-converting part 414, a test current source 416, a current path controlling part 918, a path switch Sp, etc.

The current path controlling part 918 may include a current combining part 514 that outputs a combination of a current transmitted to a first input terminal IN1 and a current transmitted to a second input terminal.

Further, the first input terminal IN1 of the current combining part 514 can be connected to each pixel P through the path switch Sp.

The path switch SP can be opened in a first mode and can be closed in a second mode.

When the path switch SP is opened in the first mode, the current combining part 514 can output a combination of a zero current generated at the first input terminal IN1 and a first current supplied from the test current source 416. Substantially, the current combining part 514 can output only the first current supplied from the test current source 416 in the first mode.

In the second mode, when the path switch Sp is closed, the current combining part 514 can output a combination of pixel currents transmitted to the first input terminal IN1 and a second current supplied from the test current source 416.

In accordance with the operation of the path switch Sp, the channel circuit 910 can create first sensing data by sensing a current supplied from the test current source 416 in the first mode and can create second sensing data by sensing the current obtained by combining the current supplied from the test current source and the pixel current transmitted from each pixel in the second mode.

Further, the pixel sensing circuit can transmit the first sensing data and the second sensing data to the data processing circuit and the data processing circuit can recognize the sensing error of each channel using the first sensing data, compensate for the second sensing data using the sensing errors, and compensate for image data in accordance with the characteristic of each pixel found out in accordance with the second sensing data.

According to the embodiments described above, it is possible to compensate for the differences existing among the channel circuits of the pixel sensing device.

The terms "comprise", "include", "have", etc. when used in this specification means that the components can exist unless specifically stated otherwise, so they should be construed as being able to further include other components. Unless otherwise defined, all terms including technical and scientific terms used herein have the same meaning as commonly understood by those skilled in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The above description merely explains the spirit of the present disclosure and the present disclosure may be changed and modified in various ways without departing from the spirit of the present disclosure by those skilled in the art. Accordingly, the embodiments described herein are provided not to limit, but explain the spirit of the present disclosure, and the spirit of the present disclosure is not limited by the embodiments. The protective range of the present disclosure should be construed by the following claims and the scope and spirit of the disclosure should be construed as being included in the patent right of the present disclosure.

CROSS-REFERENCE TO RELATED APPLICATION

The present application claims priority to Korean Patent Application No. 10-2017-0029947 filed on Mar. 9, 2017 under U.S. Patent Law Article 119(a) (35 U.S.C § 119(a)), the entire contents of which is incorporated herein for all purposes by this reference. In addition, this non-provisional application claims priorities in countries, other than the U.S., with the same reason based on the Korean Patent Applications, the entire contents of which are hereby incorporated by reference.

What is claimed is:

1. A pixel sensing device that senses currents of pixels disposed on a display panel, the pixel sensing device comprising:

a plurality of channel circuits, each of the plurality of channel circuits generates a first sensing data by sensing a first current supplied from a test current source in a first mode, and generates a second sensing data by sensing a third current obtained by combining a second current supplied from the test current source and a pixel current transmitted from each of the pixels in a second mode; and a data transmitting part that transmits the first sensing data and the second sensing data to a data processing circuit, wherein the data processing circuit recognizes sensing errors of each of the plurality of channel circuits using the first sensing data, compensates for the second sensing data using the sensing errors, and compensates for image data in accordance with a characteristic of each of the pixels found out in accordance with the second sensing data, wherein each of the plurality of channel circuits comprises:

a current combining part that generates the third current by combining the second current supplied from the test current source and the pixel current;

a first selecting part that selectively outputs the first current or the third current; and a second selecting part that outputs the first current supplied from the test current source to the first selecting part in the first mode and outputs the second current supplied from the test current source to the current combining part in the second mode.

2. The pixel sensing device of claim 1, wherein the first selecting part and the second selecting part are synchronized with a control signal received from the data processing circuit to operate.

3. The pixel sensing device of claim 1, wherein a driving transistor and an organic light emitting diode are disposed to be connected to a first node in each of the pixels, and a driving current supplied to the organic light emitting diode is controlled by the driving transistor.

4. The pixel sensing device of claim 3, wherein the pixel current is a current that is transmitted to the first node via the driving transistor or a current that flows to the organic light emitting diode via the first node.

5. The pixel sensing device of claim 3, further comprising a data driving circuit that supplies a data voltage according to image data to a gate node of the driving transistor.

6. A pixel sensing device that senses currents of pixels disposed on a display panel, the pixel sensing device comprising:

a plurality of channel circuits, each of the plurality of channel circuits generates a first sensing data by sensing a first current supplied from a test current source in a first mode, and generates a second sensing data by sensing a third current obtained by combining a second current supplied from the test current source and a pixel current transmitted from each of the pixels in a second mode; and a data transmitting part that transmits the first sensing data and the second sensing data to a data processing circuit, wherein the data processing circuit recognizes sensing errors of each of the plurality of channel circuits using the first sensing data, compensates for the second sensing data using the sensing errors, and compensates for image data in accordance with a characteristic of each of the pixels found out in accordance with the second sensing data, wherein each of the plurality of channel circuits comprises:

an analog-front-end part that receives the first current in the first mode and receives the third current in the second mode; and an analog-digital-converting part that generates the first sensing data in the first mode and generates the second sensing data in the second mode by converting an output signal of the analog-front-end part into digital data, wherein at least two or more channel circuits from the plurality of channel circuits have different offset errors of the analog-front-end parts or the analog-digital-converting parts, and wherein the analog-front-end part comprises an amplifier, a capacitor connected between an input terminal and an output terminal of the amplifier, and a reset switch connected in parallel to the capacitor, and transmits a value obtained by integrating an input current to the analog-digital-converting part.

7. A pixel sensing device that senses currents of pixels disposed on a display panel, the pixel sensing device comprising:

a plurality of channel circuits, each of the plurality of channel circuits generates a first sensing data by sensing a first current supplied from a test current source in a first mode, and generates a second sensing data by sensing a third current obtained by combining a second current supplied from the test current source and a pixel current transmitted from each of the pixels in a second mode;

a data transmitting part that transmits the first sensing data and the second sensing data to a data processing circuit; and a current combining part that combines a current transmitted to a first input terminal and a current transmitted to a second input terminal and outputs a combined current, wherein the first input terminal is connected to each of the pixels through a switch, and the switch is opened in the first mode and closed in the second mode, wherein the data processing circuit recognizes sensing errors of each of the plurality of channel circuits using the first sensing data, compensates for the second sensing data using the sensing errors, and compensates for image data in accordance with a characteristic of each of the pixels found out in accordance with the second sensing data.

8. A pixel sensing device that senses currents of pixels disposed on a display panel, the pixel sensing device comprising:

a plurality of channel circuits, each of the plurality of channel circuits generates a first sensing data by sensing a first current supplied from a test current source in a first mode, and generates a second sensing data by sensing a third current obtained by combining a second current supplied from the test current source and a pixel current transmitted from each pixel in a second mode;

a memory that stores the first sensing data and the second sensing data;

a difference compensating part that recognizes a sensing error of each of the plurality of channel circuits using the first sensing data and compensates for the second sensing data using the sensing error; and a data transmitting part that transmits the compensated second sensing data to a data processing circuit that compensates for image data in accordance with a characteristic of each of the pixels, wherein each of the plurality of channel circuits comprises:

a current combining part that generates the third current by combining the second current supplied from the test current source and the pixel current;

a first selecting part that selectively outputs the first current or the third current; and a second selecting part that outputs the first current supplied from the test current source to the first selecting part in the first mode and outputs the second current supplied from the test current source to the current combining part in the second mode, and wherein the first selecting part and the second selecting part are synchronized with a control signal generated by the difference compensating part to operate.

9. The pixel sensing device of claim 8, wherein a driving transistor and an organic light emitting diode are disposed to be connected to a first node in each of the pixels, and a driving current supplied to the organic light emitting diode is controlled by the driving transistor.

10. The pixel sensing device of claim 9, wherein the pixel current is a current that is transmitted to the first node via the driving transistor or a current that flows to the organic light emitting diode via the first node.

11. The pixel sensing device of claim 9, further comprising a data driving circuit that supplies a data voltage according to image data to a gate node of the driving transistor.

12. A pixel sensing device that senses currents of pixels disposed on a display panel, the pixel sensing device comprising:

a plurality of channel circuits, each of the plurality of channel circuits generates a first sensing data by sensing a first current supplied from a test current source in a first mode, and generates a second sensing data by sensing a third current obtained by combining a second current supplied from the test current source and a pixel current transmitted from each pixel in a second mode;

a memory that stores the first sensing data and the second sensing data;

a difference compensating part that recognizes a sensing error of each of the plurality of channel circuits using the first sensing data and compensates for the second sensing data using the sensing error;

a data transmitting part that transmits the compensated second sensing data to a data processing circuit that compensates for image data in accordance with a characteristic of each of the pixels; and a current combining part that combines a current transmitted to a first input terminal and a current transmitted to a second input terminal and outputs a combined current, wherein the first input terminal is connected to each of the pixels through a switch and the switch is opened in the first mode and closed in the second mode.

* * * * *